United States Patent [19]

Poldervaart et al.

[11] Patent Number: 4,802,432

[45] Date of Patent: Feb. 7, 1989

[54] MOORING DEVICE

[75] Inventors: Leendert Poldervaart, La Turbie; Raymond Hervouet, Cap D'Ail, both of France

[73] Assignee: Single Buoy Moorings Inc., Marly, Switzerland

[21] Appl. No.: 63,462

[22] Filed: Jun. 18, 1987

[30] Foreign Application Priority Data

Jul. 1, 1986 [NL] Netherlands ..... 8601716

[51] Int. Cl.[4] ..... B63B 21/00

[52] U.S. Cl. ..... 114/230; 441/3

[58] Field of Search ..... 114/230; 441/3-5

[56] References Cited

U.S. PATENT DOCUMENTS 4,694,771 9/1987 Poldervaart et al. ..... 441/3

FOREIGN PATENT DOCUMENTS 0096446 12/1983 European Pat. Off. .
0105976 4/1984 European Pat. Off. .
0152975 8/1985 European Pat. Off. .
0188840 7/1986 European Pat. Off. .
8402398 2/1986 Netherlands .

*Primary Examiner*—Sherman D. Basinger
*Attorney, Agent, or Firm*—Young & Thompson

[57] ABSTRACT

Mooring device comprising an element anchored to the bottom. This element, such as a column or buoy, carries a weighted structure suspended from the element with its center of gravity below the point of suspension such that it can swing about a horizontal pin and rotate about a vertical axis. The weighted structure has a rigid arm which faces away from the structure, the free end of which can be coupled with or without pretension with a ship.

2 Claims, 3 Drawing Sheets

MOORING DEVICE

Figure 1:
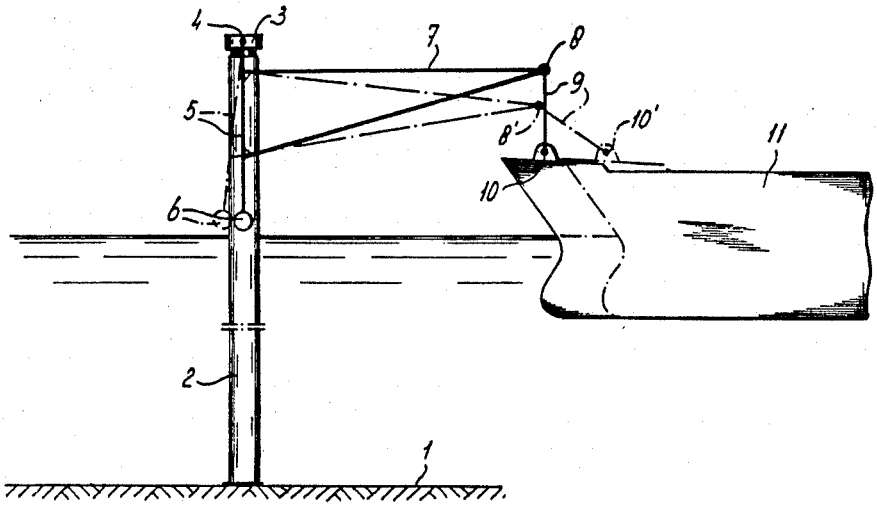

The invention relates to a mooring device, comprising an element anchored relative to the bottom, such as a column fixed to the bottom, a column placed on the bottom so that it can swing, which column has buoyancy or a buoy fixed with anchor lines relative to the bottom, or a combination of these possibilities, said element having a weighted structure suspended from it in such a way that the latter can swing about a horizontal pin situated above the centre of gravity of the structure, and said element also having an arm which faces away from it in a direction perpendicular to the horizontal hinge pin and is swingable about a vertical axis of the element.

Such a mooring device is known, and examples thereof can be found in, for example, British Patent Application No. 2,019,800 or European Patent Application No. 0,105,976.

In these known mooring devices the weighted structure comprises one or more arms which are suspended—in such a way that they can swing about a horizontal pin—from a part which is mounted, in such a way that it rotates about a vertical axis, to the upper end of a column which may or may not be fixed. The arm between the weighted structure and the ship to be moored is here hingedly connected both to the ship and to the structure, said hinge connection in the case of the ship being a horizontal hinge whose pin is at right angles to the longitudinal direction of the arm, and the connection to the structure, either being a hinge also with a horizontal transverse pin, or being a universal joint.

These mooring devices, which are known per se, provide great flexibility between the ship to be moored and the element anchored to the bottom, since the ship retains great freedom of movement relative to the anchored element, and the weighted structure acts any time like a spring to counter and correct undesirable movement of the ship.

In European Patent No. 0188840 it has already been proposed that the connection of the arm between the ship and weighted structure should be made at a point which is situated past the vertical axis of the suspension of the structure, looking from the ship to be moored, and the object of this is to give the spring action such a characteristic that the spring action initially decreases and only later becomes more rigid, in order to obtain an adjustment to the movements made by the ship in each case under the influence of wave forces.

The object of the invention now is to produce a flexible mooring device which can be coupled and uncoupled in a simple manner to and from the bulk of the ship to be moored, making use of a weighted structure.

This object is achieved according to the invention in that the arm has an essentially so rigid a connection to the structure that said arm faces away from the structure at an angle and with its free end can be freely coupled to a ship by means of a tensionable connecting element.

The arm is thus now essentially rigidly connected to the weighted structure and has a movable, but tensionable connection to the ship. The ship consequently retains great freedom of movement. If, however, undesirable movements occur, either away from the mooring element or towards it, then the arm is pulled, depending on the nature of the fastening, downwards or upwards, thereby causing the weighted structure to make a swinging movement, which results in a return adjusting force. The connecting element between the free end of the arm and the ship can be made with adjustable length, which makes it possible to pretension the spring action. Through shortening the connecting element, one already gives the weighted structure an angular position which results in an adjusting force, but said force does not take effect at that moment, for it is never great enough to raise the moored ship or press it deeper into the water. However, if a shift now takes place in the longitudinal direction of the ship which must be considered to be part of a normal shift under the influence of the wash of the waves, the spring action will increase when the ship moves away from the element and will create a return adjusting force. Moreover, by the degree of pretensioning, one can now influence the spring characteristic and its course depending on the bulk of the ship and the weather conditions.

Another advantage is that the fastening to the ship can be particularly simple. Even a winch cable is sufficient.

The invention will now be explained in greater detail with reference to the drawings.

FIGS. 1 to 6 show various embodiments schematically in side view.

FIG. 1 shows a column 2 fixed to the seabed 1, and disposed on the top end of said column a turntable or the like 3, from which is suspended, in such a way that it swivels about the horizontal pin 4, a pulling element such as a bar or cable 5, which bears a weight 6 at the bottom end. This pulling element forms the weighted structure. Such an element can be located on either side of the turntable 3. This element 5 swings in a plane parallel and adjacent to the column 2. The arm 7 comprises a triangle which is fastened to the element 5. The end 8 thereof is fixed at 10 by a connecting element 9 to a ship 11.

In FIG. 1, broken lines indicate what happens if the ship shifts to the position indicated by the broken lines, and the fastening point 10 is at 10'. Arm 7 with, for example, bar 5 and weight 6 are then swung into the position indicated by broken lines, and the weight 6 produces the return adjusting force.

It can also be seen from FIG. 1 that if the connecting element 9 is shortened in such a way that it, for example, runs between the point 10 and the point 8', the arm—and thus also the weight—will also be shifted, but then exert a constant upward force on the ship 11, which itself, due to its extensive bulk, cannot move in the vertical direction under the influence of the weight. Each horizontal movement now taking place first has to overcome the already existing return adjusting force or reach its level before a further swing of the structure and increase in the return adjusting force can take place.

Figure 2:
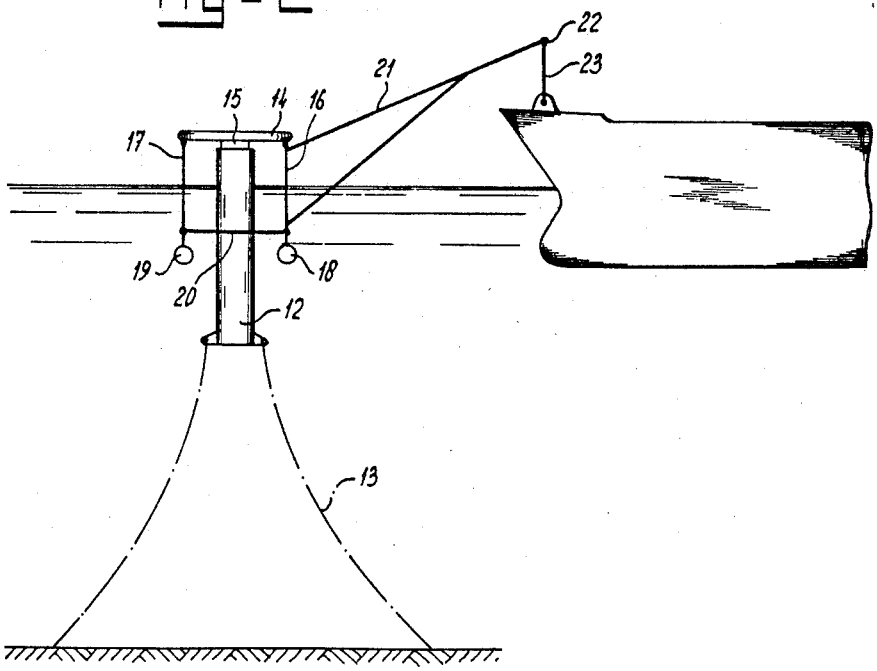

In the embodiment of FIG. 2 the element anchored relative to the bottom comprises a column-shaped buoy 12, which is fixed with anchor chains 13 and bears a turntable 14, which is rotatable about the vertical axis 15, and from which swinging bars 16 and 17 are suspended, each provided with weights 18 and 19, with duplication of what is shown in FIG. 2 on the other side of the buoy 12, said bars 16 and 17 being coupled together to a parallel guide by means of a hinged connecting rod 20. The bar 16 is again rigidly connected to the arm 21, which—essentially as shown in FIG. 1—can consist of a triangular structure. The end of the arm 21 is connected at 22 to a ship, again by means of a connecting element 23.

Figure 3:
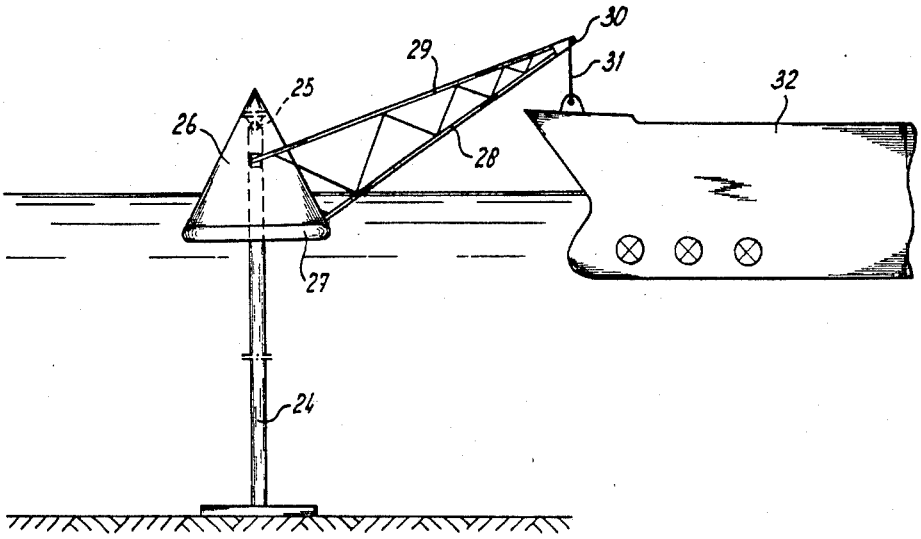

In the embodiment of FIG. 3 a column 24 stands on the bottom, said column having on its top end at 25 a closed conical element 26 which is supported by means of a ball joint, so that it can move in all directions. The element 26 preferably has a closed jacket and bears on the underside an annular weight 27, for example, a concrete-filled circular pipe running around it. Fixed on this conical element 26 is an arm, comprising a lower girder 28 and two upper girders 29 ending in the point 30, from which the flexible connecting element 31 runs again to a ship 32.

Figure 4:
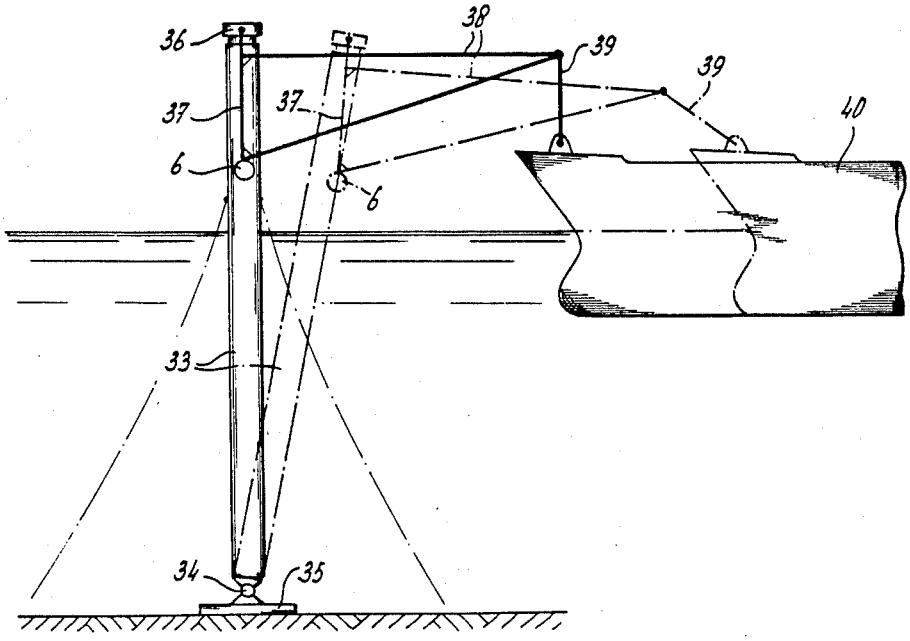

FIG. 4 shows an embodiment in which the element fixed to the bottom comprises a column 33 which at 34 is fixed to an anchor plate 35 in such a way that it swings about a hinge, for example, a cardan joint. This column again has a turntable 36, from which are suspended bars 37, which in the same way as shown in FIG. 1 are connected to the ship 40 by means of a rigid triangular arm 38 with a flexible connecting element 39. The bars 37, forming the weighted structure, carry weights as indicated at 6.

In FIG. 4 broken lines indicate what happens when the ship moves from the normal initial position indicated by solid lines, i.e. without pretensioning being created by means of the connecting element 39. The column 33 is always urged to the vertical position by floating capacity present therein.

Figure 5:
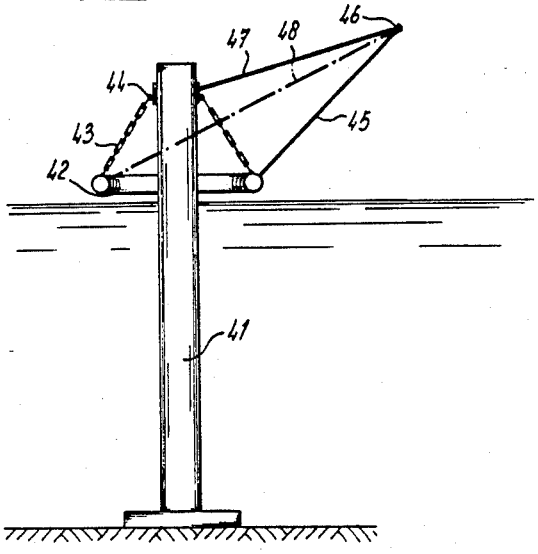

In the embodiment of FIG. 5 a rigid column 41 is shown, i.e. a column which is placed firmly on the bottom and from which an annular weight is 42 suspended by means of flexible connecting elements 43, which at 44 are rotatably fixed to a ring which is rotatable about the column. This rigid annular weight has attached to it an arm 45, whose top end 46 can be connected to a ship (not shown).

The connection can have a support by means of a tensionable connecting element 47 and, instead of the rigid arm 45, or in addition thereto, a rigid connection can also be provided as shown at 48.

Another advantage of the above-described structures is that lines and hoses can be carried easily to the ship over the rigid arm.

Figure 6:
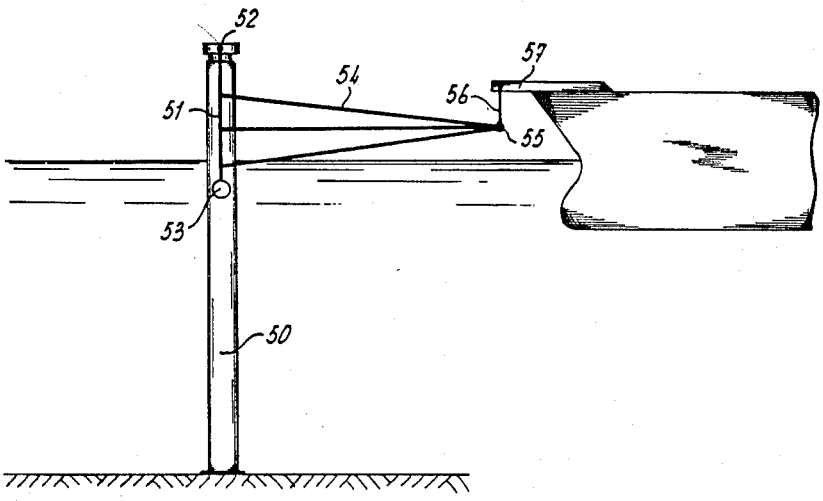

In the embodiment of FIG. 6 the mooring device comprises a rigid column 50 from which bars 51 are again suspended in such a way that they swing about the horizontal pins 52 and are rotatable about a vertical axis which is not shown, and carry a weight 53, and also comprises a rigid arm 54 whose end 55 which is connected by means of the flexible tensionable connecting element 56 top an arm 57 fixed to the ship.

This embodiment serves to demonstrate that the flexible connecting element can run not only from an end of the rigid arm above the ship downwards to the ship, but also from a lower point.

The system according to the invention is also suitable for supporting the dynamic positioning of a ship.

We claim:

1. In a mooring device comprising a mooring element anchored to the bottom of a body of water, said mooring element having a weighted structure swingably suspended from it at a location situated above the center of gravity of the weighted structure, said weighted structure being rotatable with respect to the said mooring element about a vertical axis, said device further comprising a rigid arm extending from said weighted structure toward a vessel, the connection of said arm with the vessel comprising a horizontal axis of rotation; the improvement in which the rigid arm forms a rigid entity with the weighted structure, and the end of the said rigid arm remote from the weighted structure and adjacent the vessel is connected with the vessel by means of a tension-resistant connecting element, and in which when said center of gravity of said weighted structure is in its lowest position, said tension-resistant connecting element is upright.

2. Mooring device as claimed in claim 1 wherein the length of the tension-resistant connecting element between the outer end of the arm and the ship is adjustable.

* * * * *